US006443221B1

(12) United States Patent
Suzuki et al.

(10) Patent No.: US 6,443,221 B1
(45) Date of Patent: Sep. 3, 2002

(54) CONTINUOUS CASTING APPARATUS FOR MOLTEN METAL

(75) Inventors: Noriyuki Suzuki; Eiichi Takeuchi, both of Futtsu; Teruo Kawabata; Rikiya Kanno, both of Muroran, all of (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/515,775

(22) Filed: Feb. 29, 2000

(30) Foreign Application Priority Data

Mar. 3, 1999 (JP) ..... 11-055316

(51) Int. Cl.[7] ..... B22D 27/02; B22D 11/04

(52) U.S. Cl. ..... 164/502; 164/443

(58) Field of Search ..... 164/502, 503, 164/504, 146, 147.1, 466, 467, 468, 443, 485

(56) References Cited

U.S. PATENT DOCUMENTS

| | | | | | |
|---|---|---|---|---|---|
| 3,941,183 | A | * | 3/1976 | Vedda et al. | 164/504 |
| 3,967,673 | A | * | 7/1976 | Bower, Jr. | 164/459 |
| 4,009,749 | A | * | 3/1977 | Alberny | 164/504 |
| 4,040,467 | A | * | 8/1977 | Alberny et al. | 164/468 |
| 4,150,712 | A | * | 4/1979 | Dussart | 164/504 |
| 4,299,267 | A | * | 11/1981 | Birat et al. | 164/502 |
| 4,457,354 | A | * | 7/1984 | Dantzig et al. | 164/468 |
| 5,390,725 | A | * | 2/1995 | Berclaz et al. | 164/467 |

FOREIGN PATENT DOCUMENTS

| | | | | |
|---|---|---|---|---|
| JP | 60-231554 | * | 11/1985 | B22D/11/04 |
| JP | 2274351 | A | 11/1990 | |
| JP | 4178247 | A | 6/1992 | |
| JP | 515949 | A | 1/1993 | |
| JP | 5-285589 | * | 11/1993 | B22D/11/04 |
| JP | 5285598 | A | 11/1993 | |
| JP | 6-277803 | * | 10/1994 | B22D/11/04 |
| JP | 6277803 | A | 10/1994 | |
| JP | 7148554 | A | 6/1995 | |
| JP | 7204787 | A | 8/1995 | |
| JP | 52134817 | A | 11/1997 | |
| JP | 10156489 | A | 6/1998 | |

OTHER PUBLICATIONS

Patent Abstracts of Japan, vol. 009, No. 179 (M–399), Jul. 24, 1985 & JP 60 049834 A (Mitsubishi Kinzoku KK), Mar. 19, 1985.

* cited by examiner

*Primary Examiner*—Tom Dunn
*Assistant Examiner*—Kevin P. Kerns
(74) *Attorney, Agent, or Firm*—Kenyon & Kenyon

(57) ABSTRACT

A continuous casting apparatus for molten metal is equipped with a mold having an electromagnetic coil which imparts a low frequency alternating current to the initially solidified portion of a meniscus and is formed with a plurality of divided cooling portions wherein the divided cooling portions are formed with a plurality of cooling copper plates each having cooling paths and back plates. The outer wall of the divided cooling portions is formed by facing the cooling path side of each of the divided cooling copper plates to that of the corresponding nonmagnetic stainless steel back plate and closing and fixing both plates, and the cooling copper plates are electrically insulated from each other by bonding electric insulating material to the joint faces of the cooling copper plates.

11 Claims, 12 Drawing Sheets

CONTINUOUS CASTING APPARATUS FOR MOLTEN METAL

BACKGROUND OF THE INVENTION

1. Field of the Invention

The present invention relates to a continuous casting apparatus for molten metal and, particularly, to a continuous casting apparatus which permits stabilizing the level of the molten metal during continuous casting, improving the surface properties of the continuous cast slab, and making the casting speed high.

2. Description of the Related Art

In the continuous casting technology for molten metal, in order to achieve stabilization of the level of the molten metal, smoothing of continuous cast slabs and high speed continuous casting, various continuous casting apparatuses and methods of continuous casting have currently been disclosed. The continuous casting apparatus disclosed in Japanese Unexamined Patent Publication (Kokai) No. 5-15949 (Japanese Patent No. 2611559) is equipped with a metal-made cooling mold having a water cooling structure built-in and a conducting coil which is wound around the segments of the mold and which passes a high-frequency current, for the purpose of significantly curving the meniscus portion of the molten metal by the conducting coil. The mold of the continuous casting apparatus comprises segments having a plurality of slits dividing the mold and penetrating or not penetrating the top end of the mold; the lower end of the segments is in an integrated form with the mold. Moreover, a path for water cooling is bored through the interior of each segment.

Japanese Unexamined Patent Publication (Kokai) No. 7-204787 discloses a continuous casting apparatus for metal equipped with a metal-made cooling mold having a water cooling structure built-in and a plurality of slits, and a conducting coil which is wound around the mold and which passes a high-frequency current for the purpose of significantly curving the meniscus portion of the molten metal by the conducting coil. Moreover, Japanese Unexamined Patent Publication (Kokai) No. 10-156489. discloses an inner water cooling type mold wherein the top end is divided by a plurality of slits extended in the casting direction, the lower end of the mold is in an integrated form with the mold, and segments capable of being cooled internally occupy the upper side of the mold. Deformation of the mold equipped with a high-frequency conducting coil is prevented by providing a flange in the upper portion of the mold. Japanese Unexamined Patent Publication (Kokai) No. 4-178247 discloses a process of continuous casting with a mold the wall of which is provided with slits at given intervals and around which an electromagnetic coil is wound to form an electromagnetic field. Japanese Unexamined Patent Publication (Kokai) No. 6-277803 discloses a process of continuous casting with a casting mold equipped with a high-frequency conducting coil wound around the periphery of the mold provided with a plurality of slits, and a magnet for imparting a static magnetic field crossing the casting direction at right angles. Japanese Unexamined Patent Publication (Kokai) No. 52-134817 discloses a casting process comprising imparting an electromagnetic force of about 50 to 6,000 Gauss in a pulse form to molten metal. Moreover, Japanese Unexamined Patent Publication (Kokai) No. 2-274351 discloses a method of imparting low-frequency vibration, while Japanese Unexamined Patent Publication (Kokai) No. 5-285598 discloses a method of imparting high-frequency electromagnetic vibration. Japanese Unexamined Patent Publication (Kokai) No. 7-148554 discloses a continuous casting apparatus provided with an electromagnetic coil wound around divided mold segments formed with slits which decline toward the casting direction.

BRIEF DESCRIPTION OF THE DRAWINGS

FIG. 5 relates to a continuous casting apparatus in the present invention.

SUMMARY OF THE INVENTION

Figure 1:
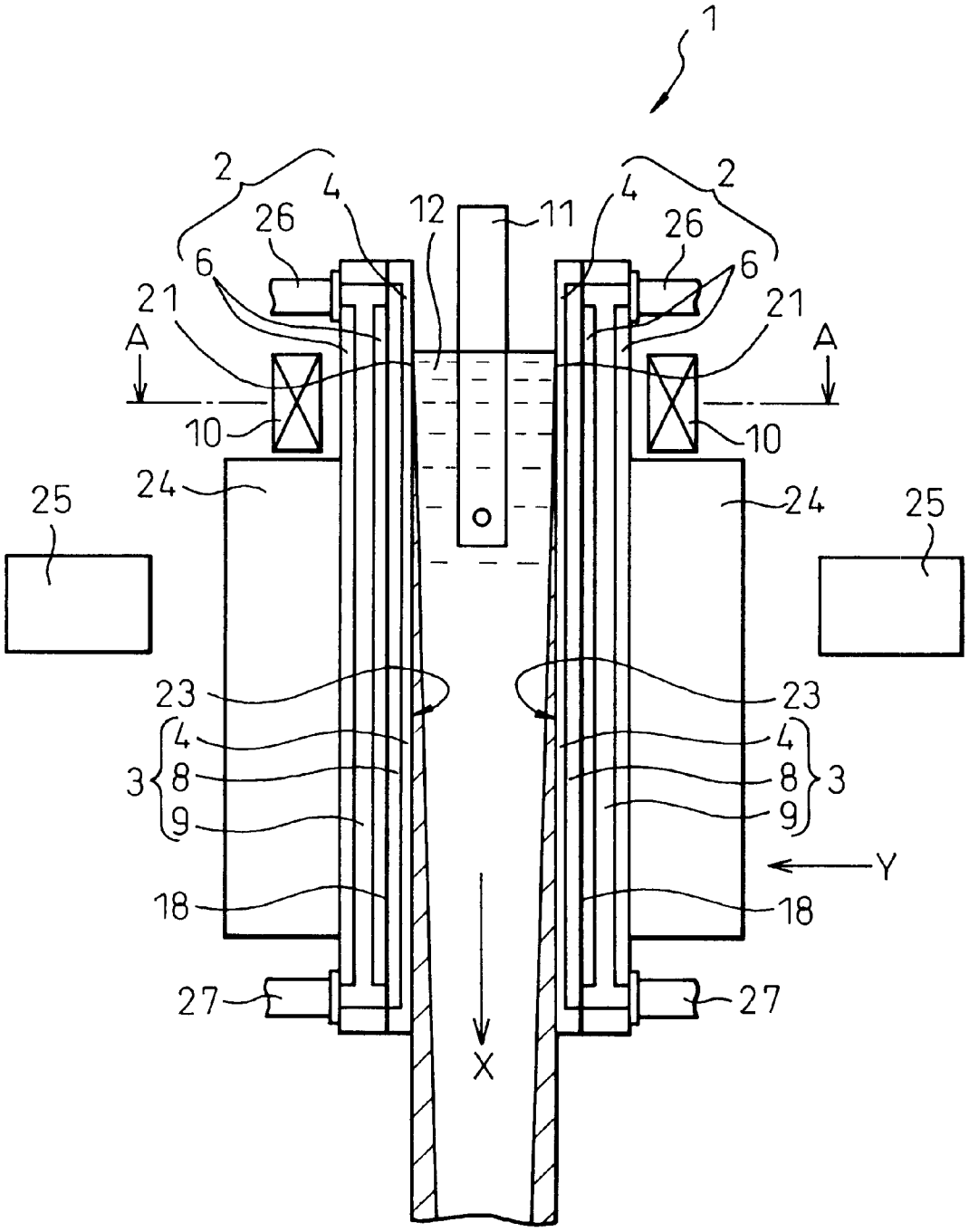
FIG. 1 shows a sectional view of a continuous casting apparatus for molten metal in the present invention.

In a continuous casting apparatus in which a magnetic field is applied to the molten metal using a high-frequency alternating current, attenuation of the magnetic field to be imparted to the entire molten metal generally increases due to an eddy current (induced current) generated in the surface of the mold peripheral to the high-frequency coil when the frequency is increased. For a structure of a mold intended to form a smooth surface of a continuous cast slab, which is one of the surface properties, by the use of a high-frequency current in the prior art technologies mentioned above, providing slits in the mold is indispensable for preventing attenuation of the magnetic field. Accordingly, slits in intervals of about 30 to 75 mm are made in each of the casting molds of the prior art, and the molds are each divided into a plurality of segments. Moreover, in order to prevent thermal deformation of the molds, the slits each do not divide the entire length of the mold but form a partial slit structure. Material filled in the slit portions, which is refractory material as well as insulating-material, is difficult to make dense. Therefore, casting molten metal into the mold structure in which the slits have been made sometimes becomes impossible due to removal of the filled material, a molten metal invasion of the slits, or a like reason. The mold of the continuous casting apparatus disclosed in Japanese Unexamined Patent Publication (Kokai) No. 5-15949 mentioned above must have a structure in which a plurality of slits do not divide the mold completely in order to prevent attenuation of the magnetic field when a high-frequency electric current is used. Moreover, when the slits reach the top end of the mold, each of the pairs of mold portions facing each other, with a central plane of the mold sandwiched between the pair of mold portions, require a beam crosslinking the mold portions within the mold in order for the mold to resist thermal deformation. Furthermore, in the continuous casting apparatus disclosed in Japanese Unexamined Patent Publication (Kokai) No. 5-15949, a flat plate-like metallic flange capable of cooling the interior of the mold must be mechanically jointed to the top end of the segments of the mold, in order to prevent the thermal deformation particularly in the upper portion of the mold. Still furthermore, the prior art technologies mentioned above each have the same problems as mentioned above. Still furthermore, the mold having the slit structure cannot be reinforced with back plates, etc., to prevent attenuation of the magnetic field, and as a result it has a poor rigidity. The mold is therefore thermally deformed, and cannot substantially be used for casting a material having a large cross-section, such as a slab. The mold contains many segments each having a structure with a cooling path built-in, and the mold has a problem that the production cost rises.

The problems to be solved as mentioned above are to permit the stabilization of the level of molten metal, the formation of smooth surface properties of a continuous cast slab and high speed casting. The problems can be solved by a continuous casting apparatus for molten metal according to the present invention as explained below.

The present invention is achieved by a continuous casting apparatus for molten metal of the present invention wherein electromagnetic force is applied in a direction vertical to the inner wall of a continuous casting mold 2 near the initially solidified portion 21 of a meniscus of molten metal 12 formed from an immersion nozzle 11 within the mold, the continuous casting apparatus 1 comprising, around the periphery of the mold, an electromagnetic coil 10 to which a low-frequency alternating current at a frequency of several tens to several hundreds of Hertz is continuously or intermittently applied, the mold comprising a pair of first cooling copper plates 4 and first nonmagnetic stainless steel back plates 6 used in combination with the copper plates, a pair of second cooling copper plates 5 and second nonmagnetic stainless steel back plates 7 used in combination with the copper plates, and a plurality of divided cooling portions 3 containing insulating material 18, the first cooling copper plates and the second cooling copper plates-each having at least one groove 8 on the side opposite to a casting face 23, each of the first and second back plates closing and fixing the face side having the at least one groove of the corresponding first or second cooling copper plate, whereby the resultant grooves form cooling paths 8, the first cooling copper plates and the second cooling copper plates being electrically insulated from each other through insulating material 18, and the first back plates and the second back plates-being insulated from each other and fastened together while they are mutually in an electrically insulated state.

Moreover, the present invention is achieved by a continuous casting apparatus for molten metal wherein electromagnetic force is applied in a direction vertical to the inner wall of a continuous casting mold 2 near the initially solidified portion 21 of meniscus of molten metal 12 within the mold, the continuous casting apparatus 1 comprising around the periphery of the mold an electromagnetic coil 10 to which a low-frequency alternating current at a frequency of several tens to several hundreds of Hertz is continuously or intermittently applied, the mold comprising a pair of first cooling copper plates 4 and first nonmagnetic stainless steel back plates 6 used in combination with the copper plates, a pair of second cooling copper plates 5 and second nonmagnetic stainless steel back plates 7 used in combination with the copper plates, and a plurality of divided cooling portions 3 containing insulating material the first cooling copper plates and the second cooling copper plates each having at least one groove 8 on the side opposite to a casting face 23, the second cooling copper plates being each divided into at least two through the entire length in the casting direction X, and each of the first cooling copper plates being insulated from the adjacent divided second cooling copper plates through insulating material 18, each of the first back plates closing and fixing the face side having the at least one groove of the corresponding first cooling copper plate, whereby the resultant grooves form cooling paths 8, insulating material 18 being inserted between each of the second back plates and the corresponding divided second cooling copper plates, and each of the second back plates insulating, closing and fixing the face side having grooves of the corresponding second cooling copper plates, whereby the second cooling copper plates are insulated from each other through the insulating material and the grooves of the second cooling copper plates form cooling paths 8, and the first back plates and the second back plates being insulated and fastened together while they are mutually in an electrically insulated state.

Moreover, the present invention is achieved by the continuous casting apparatus, of the present invention, wherein each of the second back plates is divided into at least two through the entire length in the casting direction, the second back plates and the corresponding respective second cooling copper plates are electrically contacted with or insulated from each other, each second back plates which are in a state of being divided into at least two are insulated and fastened together while they are mutually in an electrically-insulated state, and the periphery of the first and second back plates of the mold is fastened with a back frame 24 fixed to an outer frame 25.

Furthermore, the present invention is achieved by a continuous casting apparatus for molten metal wherein electromagnetic force is applied in a right angled direction to the inner wall of a continuous casting mold 2 near the initially solidified portion 21 of meniscus of molten metal 12 within the mold, the continuous casting apparatus 1 comprising around the periphery of the mold an electromagnetic coil 10 to which a low-frequency alternating current at a frequency of several tens to several hundreds of Hertz is continuously or intermittently applied, the mold comprising a pair of first cooling copper plates 4 and first nonmagnetic stainless steel back plates 6 used in combination with the cooling copper plates, a pair of second cooling copper plates 5 and second nonmagnetic stainless steel back plates 7 used in combination with the cooling copper plates, and a plurality of divided cooling portions 3 containing insulating material 18, the first cooling copper plates and the second cooling copper plates each having at least one groove 8 on the side opposite to a casting face 23, the first and second cooling copper plates being each divided into at least two through the entire length in the casting direction X, and the divided first cooling copper plates and the divided second cooling copper plates being insulated from each other through insulating material 18, insulating material 18 being inserted between each of the first back plates and the corresponding divided first cooling copper plates and between each of the second back plates and the corresponding divided second cooling copper plates, and each of the first back plates insulating, closing and fixing the face side having grooves of the corresponding first cooling copper plates and each of the second back plates insulating, closing and fixing the face side having grooves of the corresponding second cooling copper plates, whereby the first and second cooling copper plates are insulated from each other through the insulating material and the grooves of the first and second cooling copper plates form cooling paths 8, and the first back plates and the second back plates being insulated and fastened together while they are mutually in an electrically insulated state.

Moreover, the present invention is achieved by the continuous casting apparatus, wherein each of the first back plates and/or each of the second back plates is divided into at least two through the entire length in the molding direction, the divided first back plates and the corresponding respective first cooling copper plates are electrically contacted with or insulated from each other and/or the divided second back plates and the corresponding respective second back plates are electrically contacted with or insulated from each other, the back plates in a state of being divided into at least two are insulated from each other and fastened together while they are mutually in an electrically insulated state, and the periphery of the first back plates and the second back plates of the mold is fastened with a back frame 24 fixed to an outer frame 25.

Moreover, the present invention is achieved by the continuous casting apparatus, wherein the first back plates and the second back plates each comprise cooling holes 9 which are partially or entirely extended in each of the back plates.

Furthermore, the present invention is achieved by the continuous casting apparatus, wherein the conditions of the mold are determined in order to allow an effective magnetic pressure factor A which is for exciting electromagnetic force in a direction vertical to the inner wall of the mold near the initially solidified portion of meniscus of the molten metal and which is defined by the following formula to fall into a specific range:

$$A=P\times n/\{L\times(50t_1+t_2)\times\sqrt{f}\}$$

wherein P is an applied power of a power source for exciting electromagnetic force, n is a number of division of the mold, L is an inner peripheral length of the mold, f is a frequency of the power source for exciting electromagnetic force, $t_1$ is a thickness of a copper plate and $t_2$ is a thickness of a back plate.

Moreover, the present invention is achieved by the continuous casting apparatus, wherein the pitch of division of the divided second cooling copper plates, or the divided first and second cooling copper plates, or the divided cooling copper plates and the divided back plates is at least 100 mm.

Furthermore, the present invention is achieved by the continuous casting apparatus, wherein the insulating material is an electrically insulating ceramic plate.

Moreover, the present invention is achieved by the continuous casting apparatus, wherein the joint faces of any of the cooling copper plates and its adjacent cooling copper plate, the joint faces of any of the cooling copper plates and its corresponding back plate, or the joint faces of any of the back plates and its adjacent back plate are flame sprayed with electric insulating ceramics in place of the insulating material.

Furthermore, the present invention is achieved by the continuous casting apparatus, wherein the closing and fixing of the cooling path side of each of the cooling copper plates and the cooling path side of the corresponding nonmagnetic stainless steel back plate is conducted by diffusion bonding.

DESCRIPTION OF PREFERRED EMBODIMENTS

In a continuous casting apparatus for molten metal, the attenuation of a magnetic field applied to the molten metal can be significantly decreased by applying a low-frequency alternating current in place of applying a high-frequency alternating current, to a coil wound around the mold. When a low-frequency alternating current is continuously or intermittently applied to a coil wound around the mold in the present invention, attenuation of the magnetic field imparted to the molten metal is decreased. As a result, the number of divisions of the divided cooling portions of the mold can be greatly decreased. In the present invention attention has been given to the advantage. Formation of each of the divided cooling portions of the mold is made possible by supporting and fixing each of the divided cooling copper plates with a nonmagnetic stainless steel back plate so that the rigidity of the assembled mold is reinforced. A decrease in the number of the divided cooling portions of the mold, namely, enlargement of the divided cooling portions enables the cooling area to increase. Since the divided cooling portions of the mold have a structure formed by preparing cooling paths before closing and fixing, and subsequently closing and fixing the cooling copper plates and the corresponding respective back plates, the production cost can be cut. Preparation of the back plates with a nonmagnetic stainless steel can reduce eddy current generated in the back plates themselves, and further improves the efficiency of the magnetic field of the electromagentic coil imparted to the solidified portion of meniscus of the molten metal. Furthermore, insulating material is put into gaps among the cooling copper plates, gaps among the back plates and the corresponding respective cooling copper plates and gaps among the back plates, and the cooling copper plates and the back plates are fastened, whereby realization of an integratedly fastened mold structure having the cooling copper plate and the back plate of each of the divided cooling portions electrically divided individually becomes possible. As a result, the low-frequency alternating current can further be decreased. Moreover, the back plates can be electrically insulated from each other by maintaining the gap spaces there among while none of insulating material is put into the gaps. In this case, sites to be insulated are arbitrarily selected in accordance with the capacity of low-frequency alternating current. Furthermore, intermittent application of a low-frequency alternating current to the electromagnetic coil wound around the mold permits stabilizing the level of the molten metal, smoothing the surface properties of the continuous cast slab, and making the casting speed high.

For the mold of a continuous casting apparatus in the present invention, in order to excite electromagnetic force in a direction vertical to the inner wall of the mold near the initially solidified portion of meniscus of the molten metal, the conditions of the mold are determined so that an effective magnetic pressure factor A defined by the following formula falls into a specific range:

$$A=P\times n/\{L\times(50t_1\times t_2)\times\sqrt{f}\}$$

wherein P is an applied power (MW) of a power source for exciting electromagnetic vibration, n is a number of division (–) of the mold, L is an inner peripheral length (m) of a mold, f is a frequency (Hz) of the power source for exciting electromagnetic vibration, $t_1$ is a thickness (m) of a copper plate and $t_2$ is a thickness (m) of a back plate.

When the effective magnetic pressure factor A becomes less than 0.3, the magnetic pressure generated in a direction vertical to the inner surface of the mold becomes insufficient, smoothing the surface properties of the continuous cast slab becomes unsatisfactory. When the effective magnetic pressure factor A becomes larger than 1.5, the low-frequency alternating current passed through the electromagnetic coil becomes excessive, and the metal peripheral to the electromagnetic coil is overheated, which retards the development of the molten metal into a solidified shell.

Accordingly, the effective magnetic pressure factor A is preferably in the range of 0.3 to 1.5.

The fixing faces of the cooling copper plates and back plates in the divided cooling portions are generally closed and fixed with bolts. In order to close and fix cooling paths provided to the fixing faces of the cooling copper plates and back plates, O-rings are sandwiched between the fixing faces peripheral to the cooling paths of both the cooling copper plates and the back plates. Moreover, insulating material is inserted between the fixing faces of the cooling copper plates and the back plates in accordance with a low-frequency alternating current capacity, and fixed. In order to ensure a satisfactory cooling path area, prevent insufficient heat extraction from the molten metal and avoid the worst destruction, the dividing pitch of the divided cooling portions of the mold is determined to be at least about 100 mm.

For a mold provided with slits penetrating the upper portion of the mold in the prior art, substances such as inorganic adhesives must be embedded therein. However, these substances are easily peeled off during casting because densification of these substances is difficult and because these substances do not adhere well to the base material of the mold, and use of the mold over a long period of time has been impossible. Accordingly, in the present invention, a mold is divided through the entire length in the casting direction and, as a result, the joint faces of the individually separate cooling copper plates can be worked with high precision. Therefore, electrically insulating ceramic plates can be bonded to the joint faces of each of the cooling copper plates and its adjacent cooling copper plate, and the joint faces can be flame sprayed with electrically insulating ceramics. Adhesion of the joint faces between each of the cooling copper plates of the mold and its adjacent cooling copper plate is improved, and the heat resistance of the mold is improved, which permits long term use of the mold.

In the present invention, the fixing face of a cooling copper plate and that of a corresponding back plate in each of the divided cooling portions of the mold can be closed and fixed with bolts. Moreover, the cooling copper plate and the back plate can be jointed and fixed by diffusion bonding the fixing faces of the cooling copper plate and the back plate. The procedure has the following advantages: use of O-rings becomes unnecessary; the cooling area is enlarged; the heat resistance is improved; and machining the mold can be simplified.

The present invention will be explained further by making reference to drawings. FIG. 1 shows a sectional view of a continuous casting apparatus for molten metal according to the present invention. As shown in FIG. 1, a continuous casting apparatus 1 of molten metal is equipped with an electromagnetic coil 10 around the peripheral surface of a mold 2 to which an alternating current at frequencies as low as from several tens to several hundreds of Hertz is applied continuously or intermittently so that electromagnetic force is excited in an initially solidified portion of meniscus 21 of molten metal 12 within the mold 2 in a direction vertical to the inner wall of the mold 2.

Figure 2:
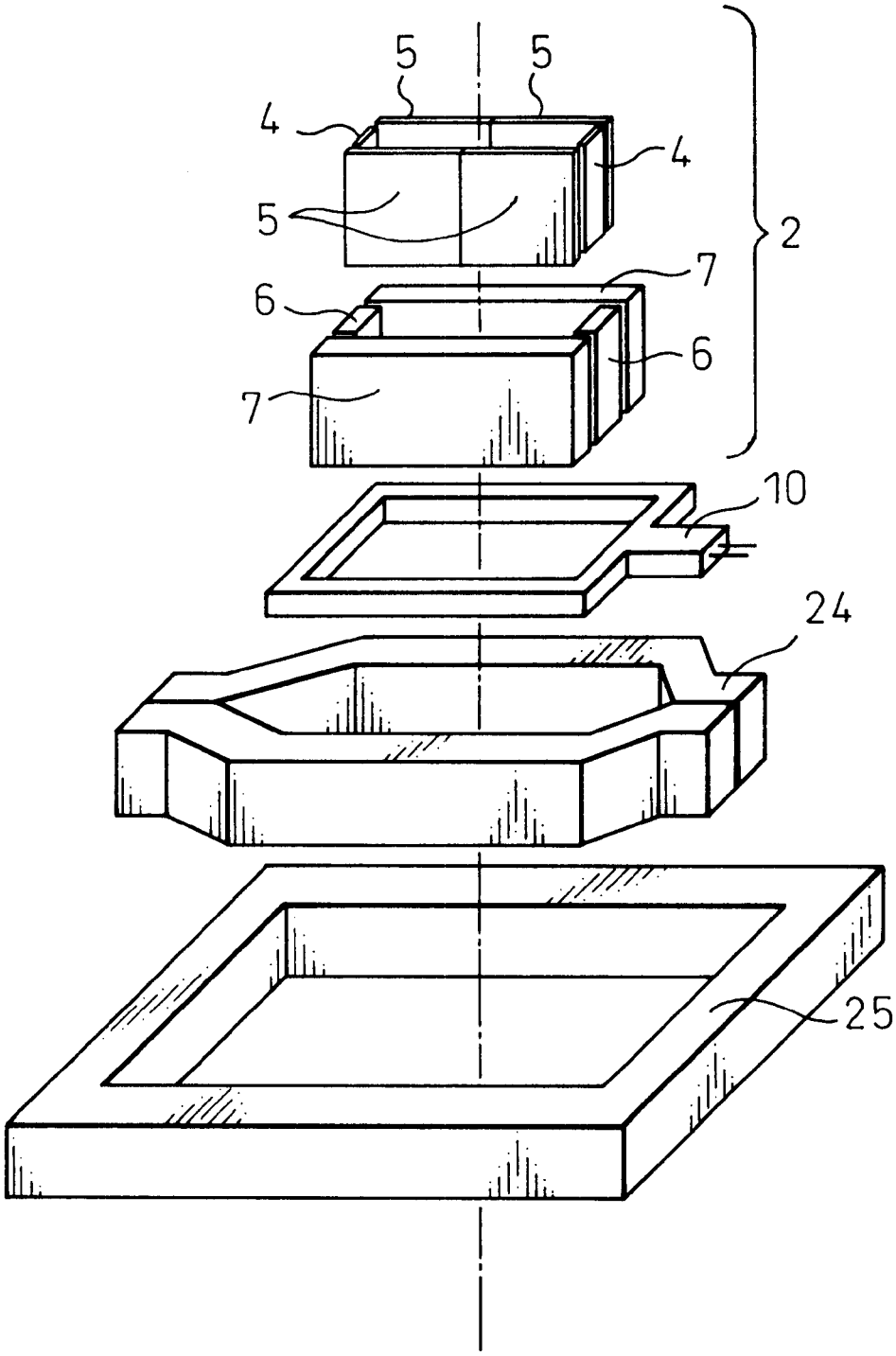
FIG. 2 is one embodiment of an assembly schematic diagram of a continuous casting apparatus in the present invention.
Figure 3:
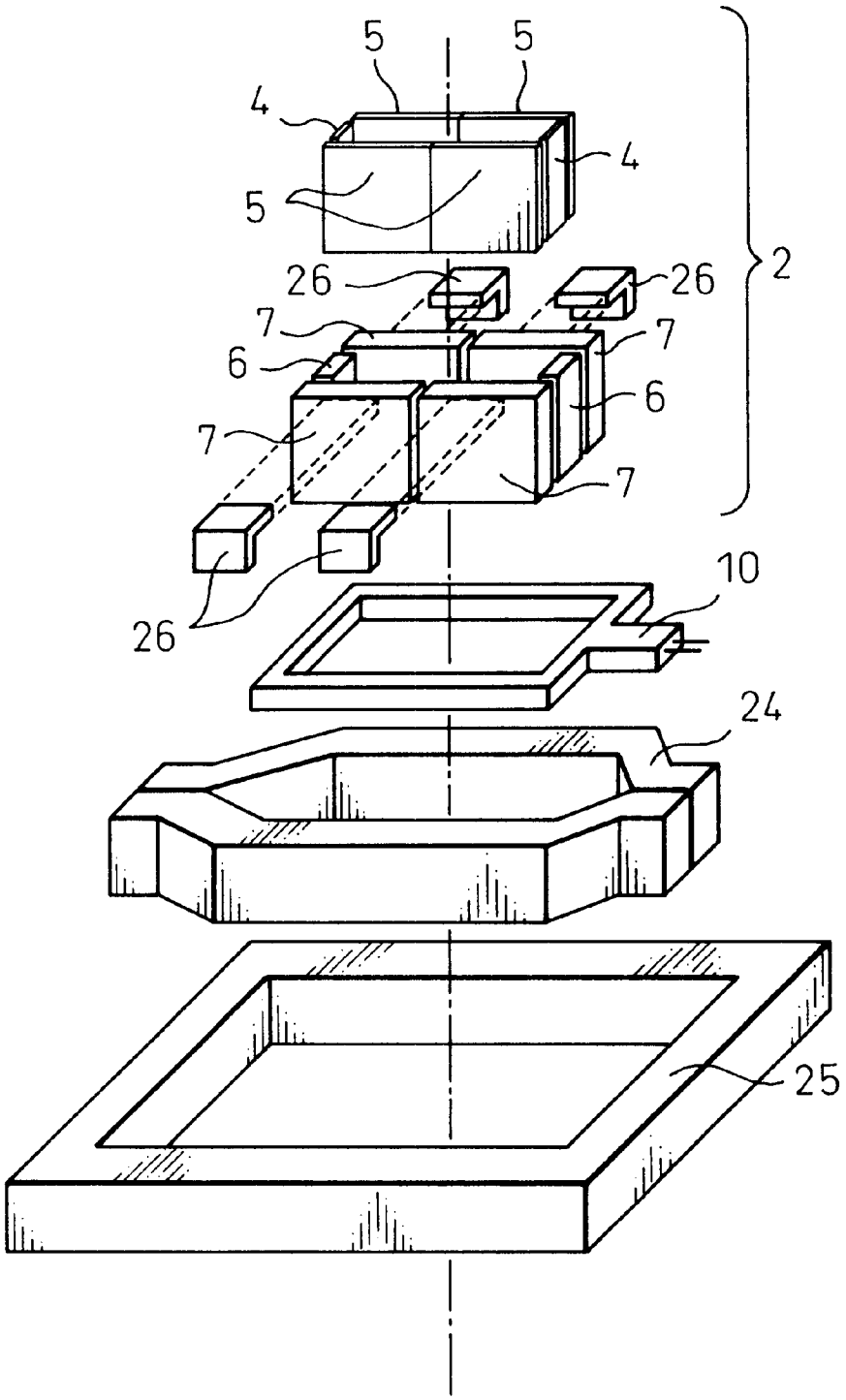
FIG. 3 shows another embodiment of an assembly. schematic diagram of a continuous casting apparatus in the present invention.

FIGS. 2, 3 show assembly schematic diagrams of a continuous casting apparatus 1 of the present invention. The continuous casting apparatus 1 of the present invention is equipped with a mold 2, an electromagnetic coil 10, a back frame 24 and an outer frame 25. Moreover, the mold 2 is formed with first cooling copper plates 4 and first back plates 6 (shorter sides of a conventional mold), and second cooling copper plates 5 and second back plates 7 (longer sides of a conventional mold). Each of the molds 2 is divided depending on the casting conditions, and can arbitrarily have grooves (cooling paths) 8, cooling paths 9, cooling water inlets 26 and cooling water outlets 27. The mold 2 of the present invention comprising divided cooling portions 3 is insulation fastened with the back frame 24, and fixed to the outer frame 25. The back frame also reinforces the rigidity of the mold.

Figure 4:
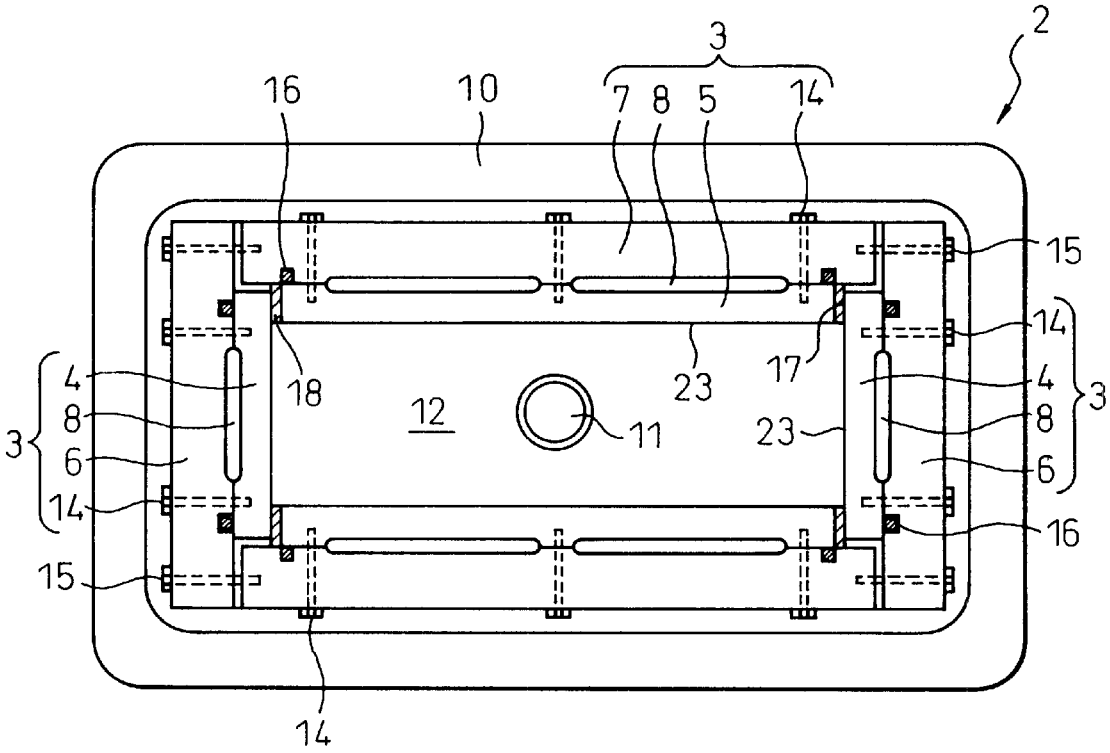
FIG. 4 relates to a continuous casting apparatus in the present invention, and shows a sectional view taken along the line A—A in FIG. 1.

As shown in FIG. 4, when an increase in the attenuation of the magnetic field is slight (when generation of the eddy current is slight) in the mold 2, four joint faces 17 alone of the cooling portions 3 formed with the first cooling copper plates 4 and the corresponding respective first back plates 6, namely, a pair of shorter sides of a conventional mold, and the cooling portions 3 formed with the second cooling copper plates 5 and the corresponding respective second back plates 7, namely, a pair of longer sides of the conventional mold are mutually and insulatedly fastened. Furthermore, when the attenuation of the magnetic field is excessive, insulating material is inserted between each of the second cooling copper plates 5 and the corresponding second back plate 7, and the copper plates and the back plates are insulation fastened with insulated fastening bolts 15.

Figure 5A:
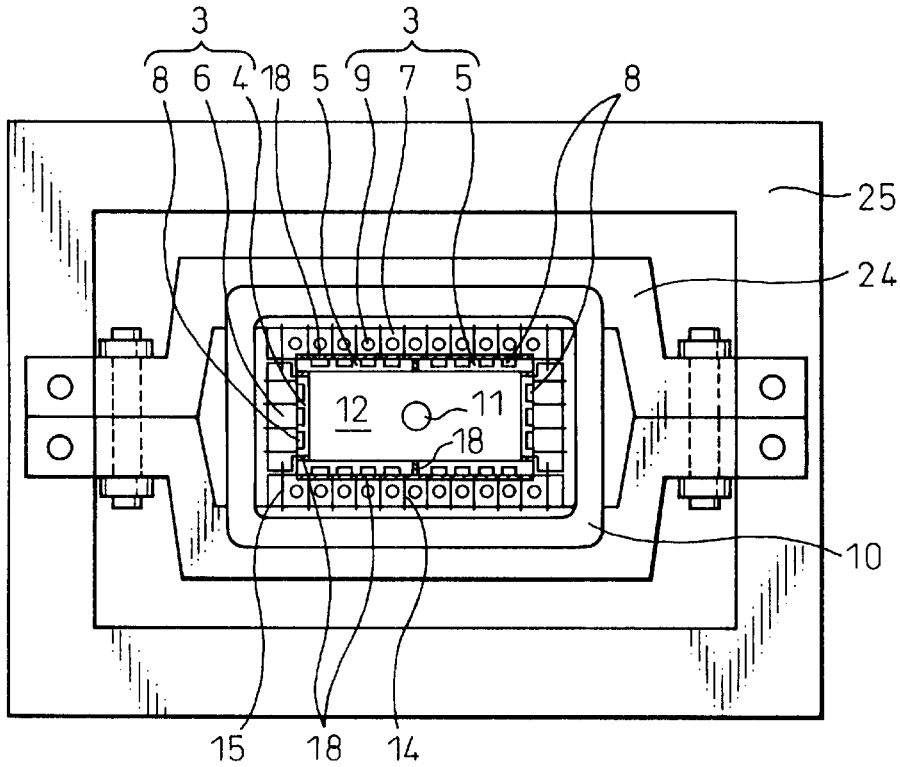
FIG. 5(A) shows a sectional view taken along the line A—A in FIG. 1.
Figure 8:
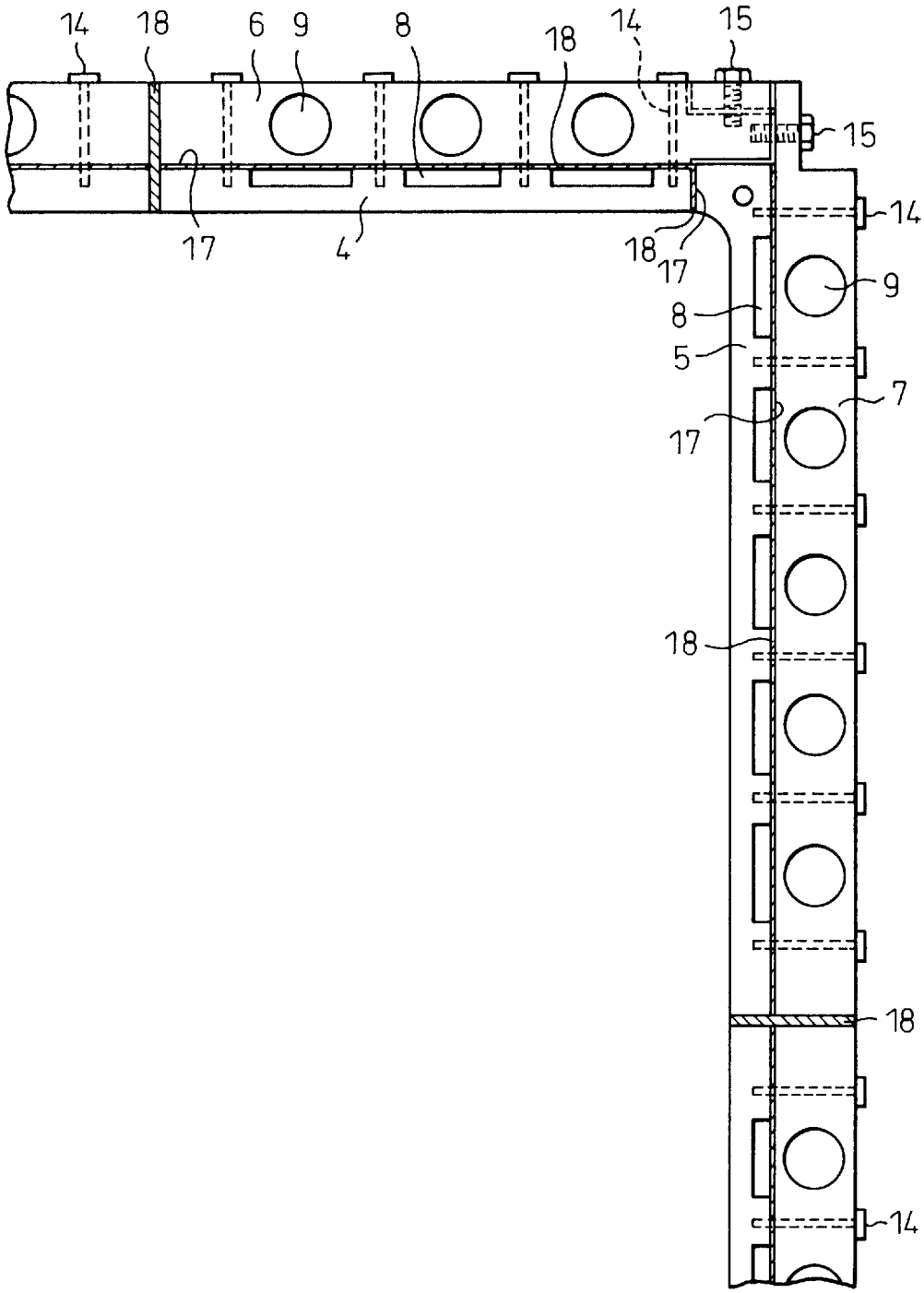
FIG. 8 shows fastened sectional portions of the first and second cooling portions of a mold in the present invention, and fastened sectional portions of the divided first and second cooling copper plates and the divided first and second back plates.
Figure 9:
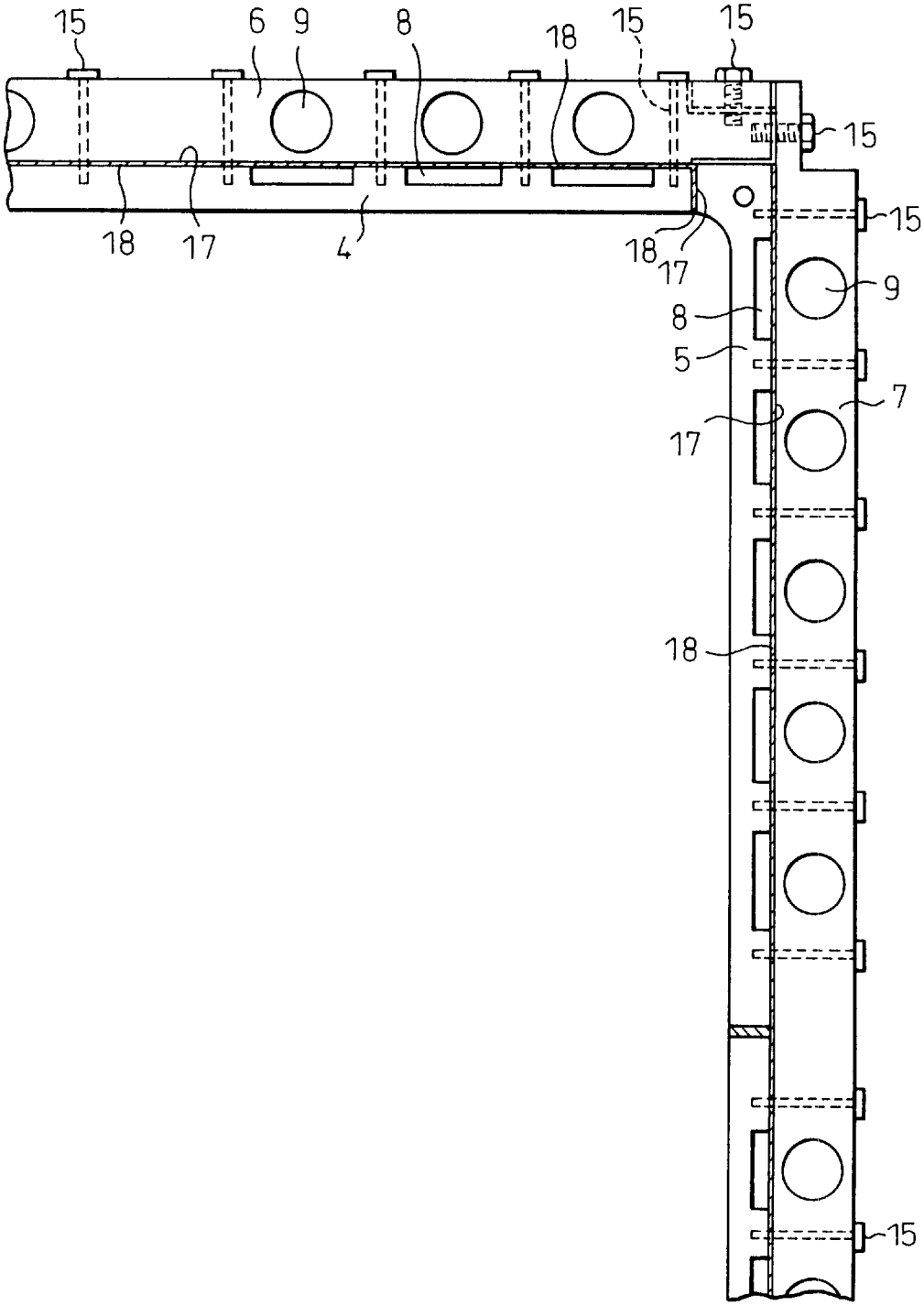
FIG. 9 shows fastened sectional portions of the first and second cooling portions of a mold in the present invention, and a fastened sectional view of the first cooling copper plate and the divided second cooling copper plates and the second back plate.

Furthermore, FIG. 8 shows a fastened section in the case where the cooling copper plates 4, 5 and the back plates 6, 7 are each divided and the opposite faces are insulated. Insulation material 18 is inserted between joint faces of the cooling copper plates, 4, 5 and the back plates 6, 7 in the divided cooling portions 3, and the cooling copper plates and the corresponding respective back plates are insulatedly fastened. When the rigidity of the mold is to be ensured while an increase in the attenuation of the magnetic field is allowed to some extent, the cooling copper plates alone can be divided. FIG. 5(A) shows a sectional view of a mold of the present invention in which the second cooling copper plates 5 alone are divided. The divided cooling portions 3 formed with the first cooling copper plates 4 and the first back plates 6, and the divided cooling portions 3 formed with the second cooling copper plates 5 and the second back plates 7 are formed with a plurality of the cooling copper plates 4, 5 having cooling paths 8 arranged on the side of the molten metal 12 and the nonmagnetic stainless steel back plates 6, 7 each situated outside the corresponding respective cooling copper plates with the insulating material sandwiched between the copper plates and between each of the copper plates and the corresponding back plate. The first cooling copper plates 4 and the first back plates 6 can also be fixed with conventional jointing bolts 14 because the first cooling copper plates 4 are insulated from the second cooling copper plates 5 with the insulating material 18 and because the first back plates 6 are insulated from the second back plates 7 with insulated jointing bolts 15. That is, the divided cooling portions 3 are formed by making the nonmagnetic stainless steel back plates 6, 7 face the cooling copper plates 4, 5, respectively, through the cooling paths 8 and the insulating material 18, and closing and fixing the back plates 6, 7 and copper plates 4, 5 with the insulated fastening bolts (shown in FIG. 9). Moreover, in order to increase the cooling efficiency of the mold, the back plates 6, 7 are each preferably provided with a plurality of cooling paths. In order to prevent the leakage of cooling water from the cooling paths 8 formed with the cooling copper plates 4, 5 and the back plates 6, 7, a groove into which seal parts such as O-rings are inserted can be provided to the periphery of each of the cooling paths 8. Moreover, the divided cooling portions 3 are insulated from each other, and fastened and fixed to give a mold.

Figure 5B:
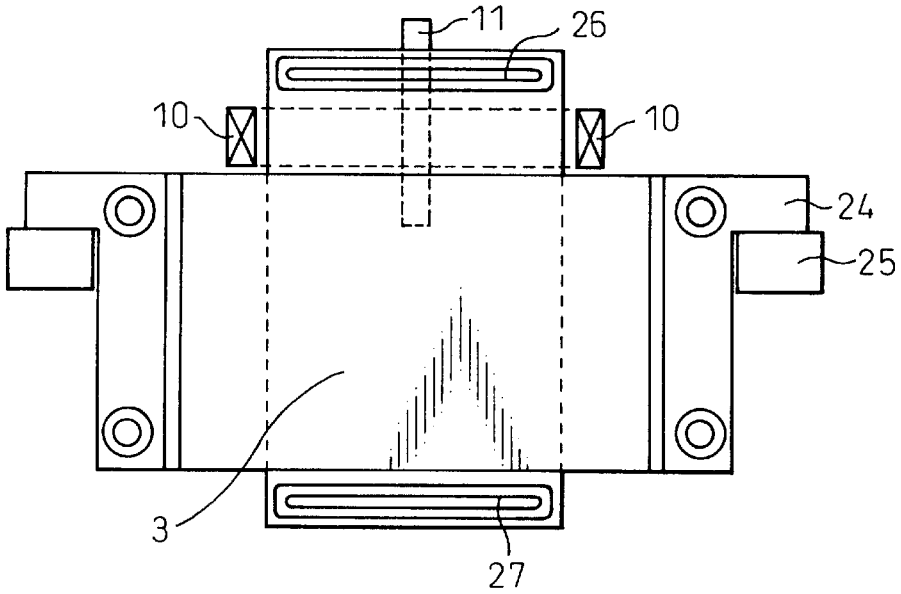
FIG. 5(B) shows a side view of the continuous casting apparatus from the Y-direction in FIG. 1.

Furthermore, as shown in FIGS. 5(A) and 5(B), the portion of the mold 2 near the initially solidified portion of the meniscus is surrounded by the electromagnetic coil 10, and electromagnetic force is applied to the molten metal in a direction vertical to the inner wall of the mold.

Figure 6:
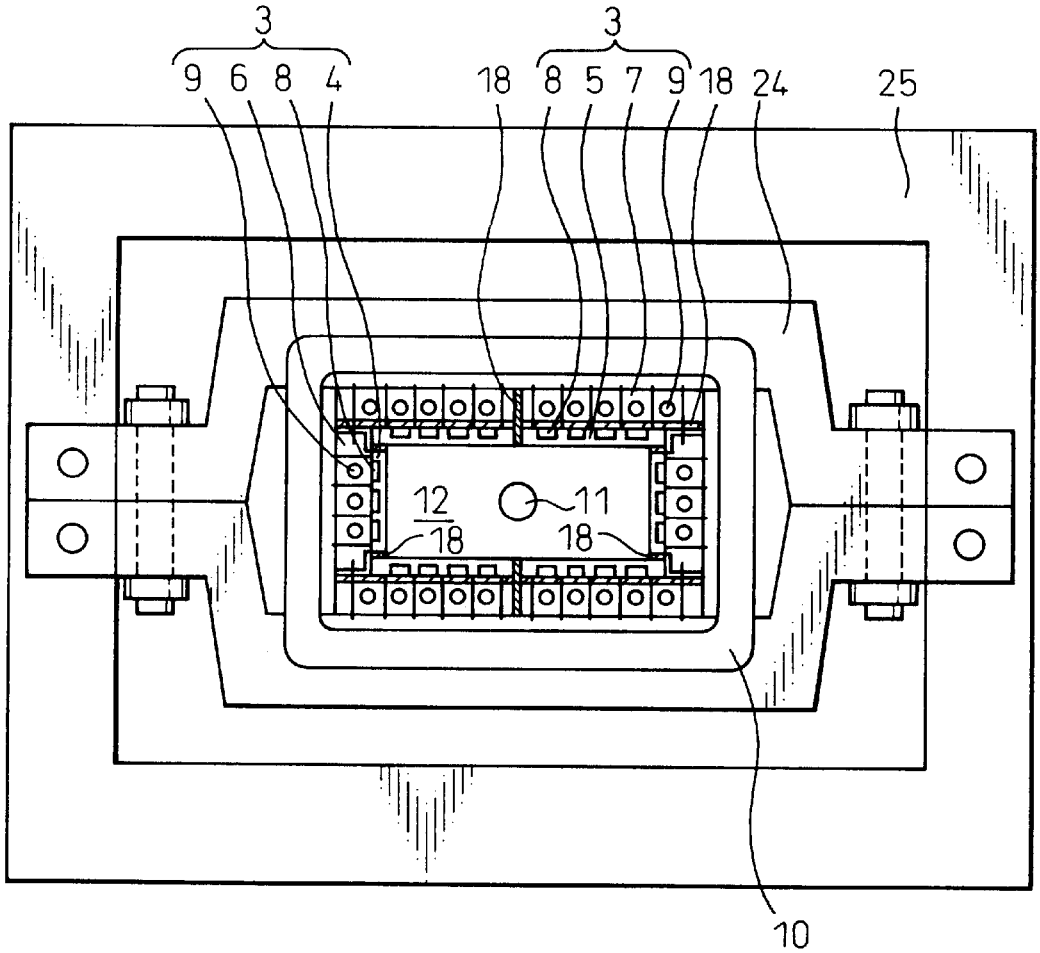
FIG. 6 is a sectional view taken along the line A—A in FIG. 1 of a continuous casting apparatus in the present invention, and shows an embodiment of the divided second cooling copper plates and the divided second back plates.
Figure 7:
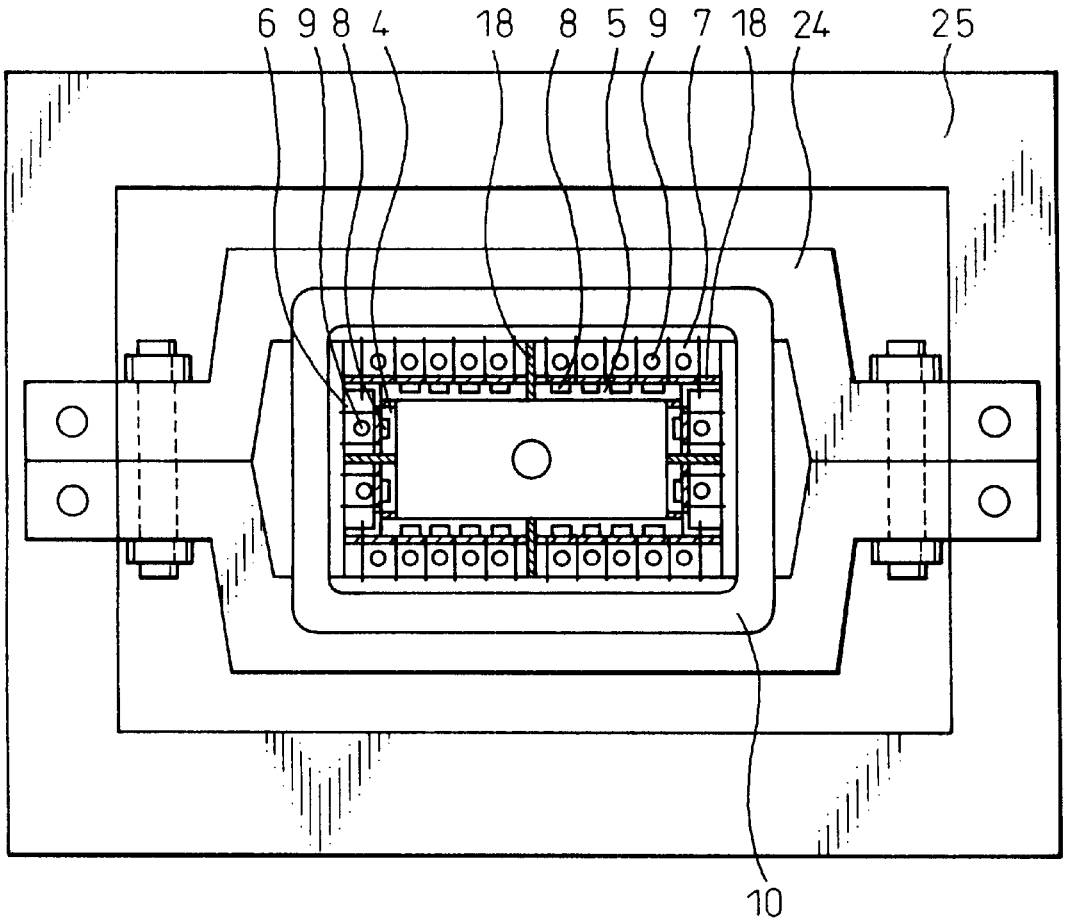
FIG. 7 is a sectional view taken along the line A—A in FIG. 1 of a continuous casting apparatus in the present invention, and shows an embodiment of the divided first and second cooling copper plates and the divided first and second back plates.

When the width of the longer sides (second cooling portions) of the mold is large and, as a result, attenuation of the magnetic field is excessive, the second cooling copper plates 5 and the second back plates 7 are preferably divided as shown in FIG. 6. Moreover, in order to increase the cooling efficiency of the mold, a plurality of cooling paths 9 are preferably provided to each of the back plates 6, 7. When the width of the shorter sides (first cooling portions) is large and, as a result, attenuation of the magnetic field is excessive, the first cooling copper plates and the first back plates are divided preferably as shown in FIG. 7. In order to increase the cooling efficiency of the mold, a plurality of cooling paths are preferably provided to each of the back plates 6, 7 also in this case.

Figure 10:
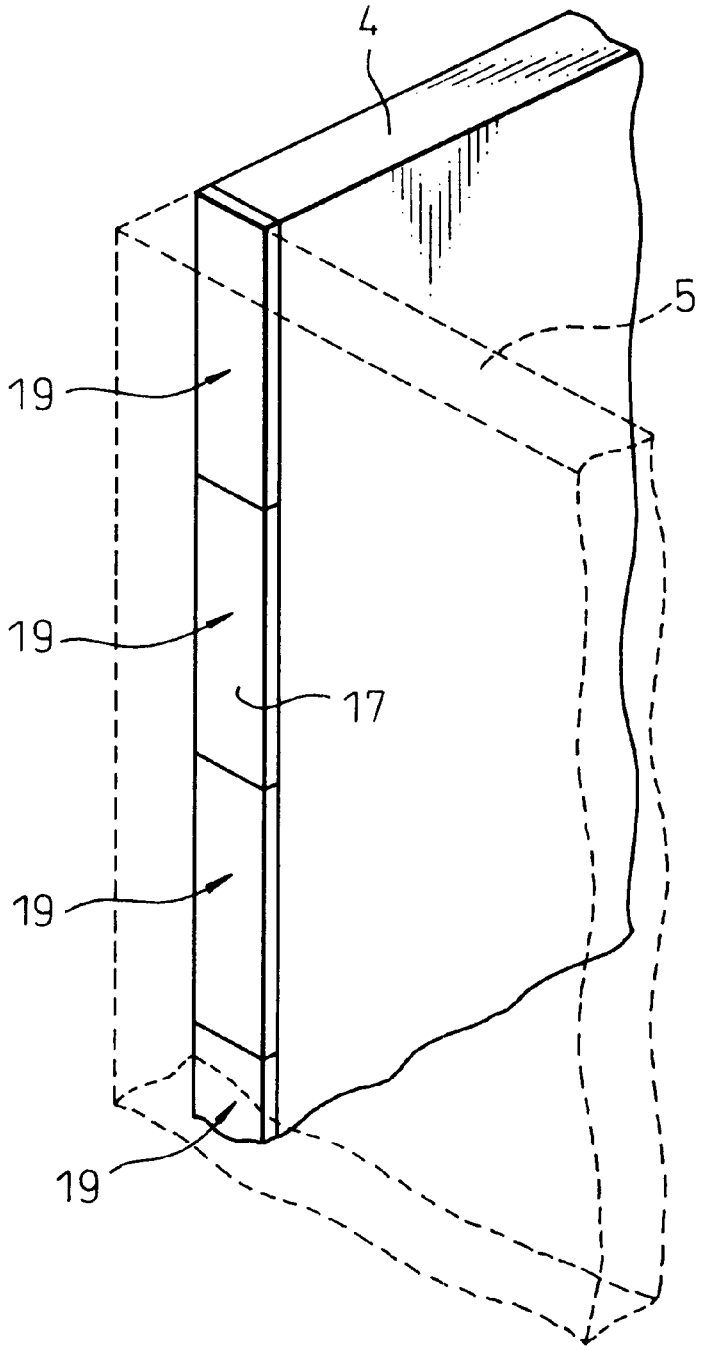
FIG. 10 shows a fragmentary view of jointed divided cooling copper plates the joint faces of which are provided with ceramic plates for the purpose of insulating the divided cooling copper plates from each other at the joint faces.

FIG. 10 shows a fragmentary view of the jointed cooling copper plates 4, 5 of which the joint faces 17 are provided with ceramic plates 19 so that the cooling copper plates 4, 5 are insulated from each other. The electric insulating ceramics is a very pure (99.5%) $A1_2O_3$ ceramic plate. The ceramic plates 100 mm long and 14 mm wide (the width being equal to the finish thickness of the cooling copper plates) are ground to have a thickness of 1.0 mm after sintering, and the resultant ceramic plates are bonded to the joint faces 17 of the cooling copper plates 4, 5.

The following insulating materials 18 may also be omitted: the insulating material 18 between the second cooling copper plate 5 and the second back plate 7 in FIG. 6; and the insulating material 18 between the first cooling copper plate 4 and the first cooling copper plate 6, and the insulating material 18 between the second cooling copper plate 5 and the second back plate in FIGS. 7 and 8. That is, even when each pair of the cooling copper plate and the back plate are electrically contacted with each other, the effect of the present invention can be obtained because the divided cooling portions insulated from each other by the insulating material 18 present in the divided first and/or divided second copper plates.

Figure 11:
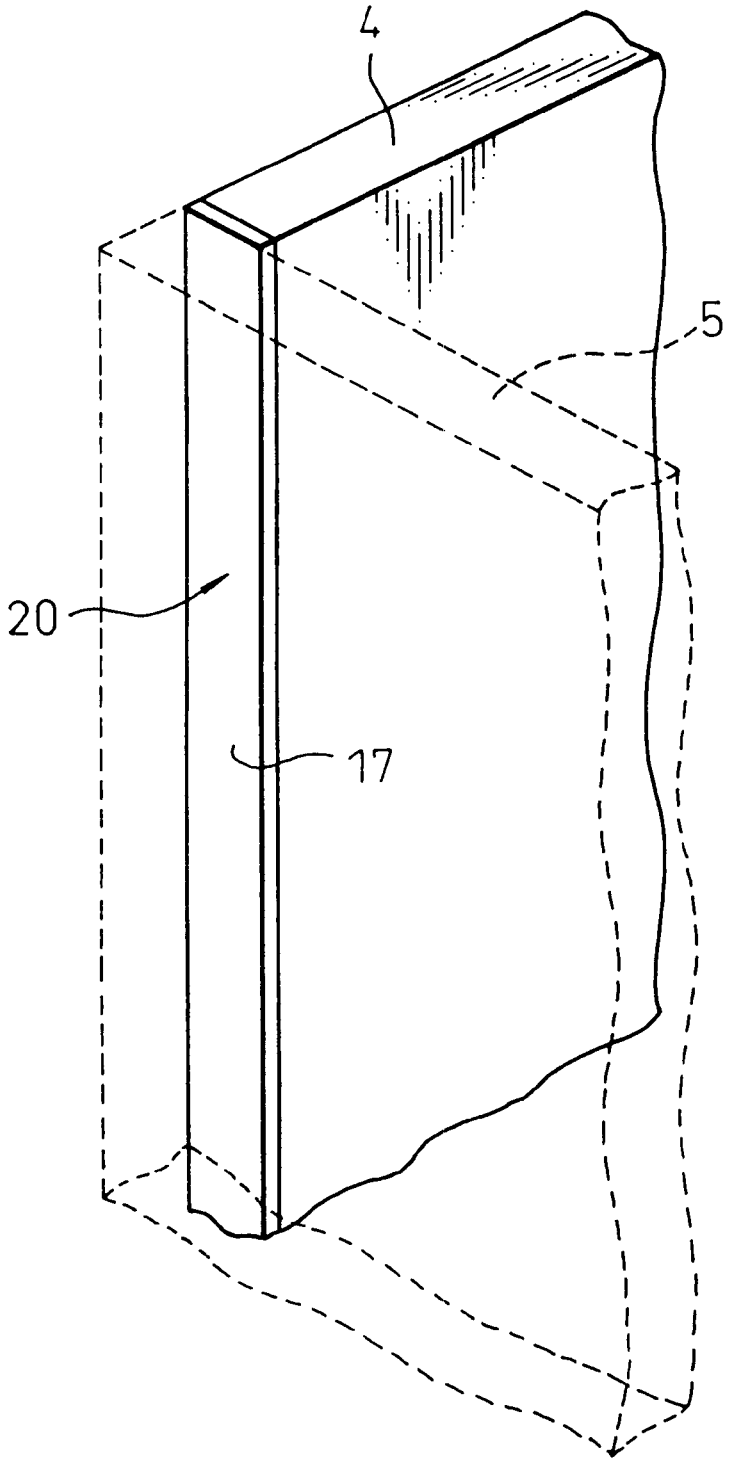
FIG. 11 shows a joint fragmentary view of jointed divided cooling copper plates the joint faces of which are flame sprayed with ceramics for the purpose of insulating the divided cooling copper plates from each other at the joint faces.

In the present invention, joint faces 17 between the cooling copper plate 4 and the cooling cooper plate 5 are flame sprayed with ceramics to electrically insulate the cooling copper plates 4, 5 from each other in place of using the ceramic plate 19. FIG. 11 shows a fragmentary view of jointed cooling copper plates in which the joint faces 17 are flame sprayed with ceramics 20 so that the cooling copper plates 4, 5 are insulated from each other. The electric insulating flame sprayed ceramic is formed by flame spraying the joint faces 17 of the cooling copper plates 4, 5 with $ZrO_2$, and polishing the ceramic to a thickness of 0.5 mm.

Figure 12:
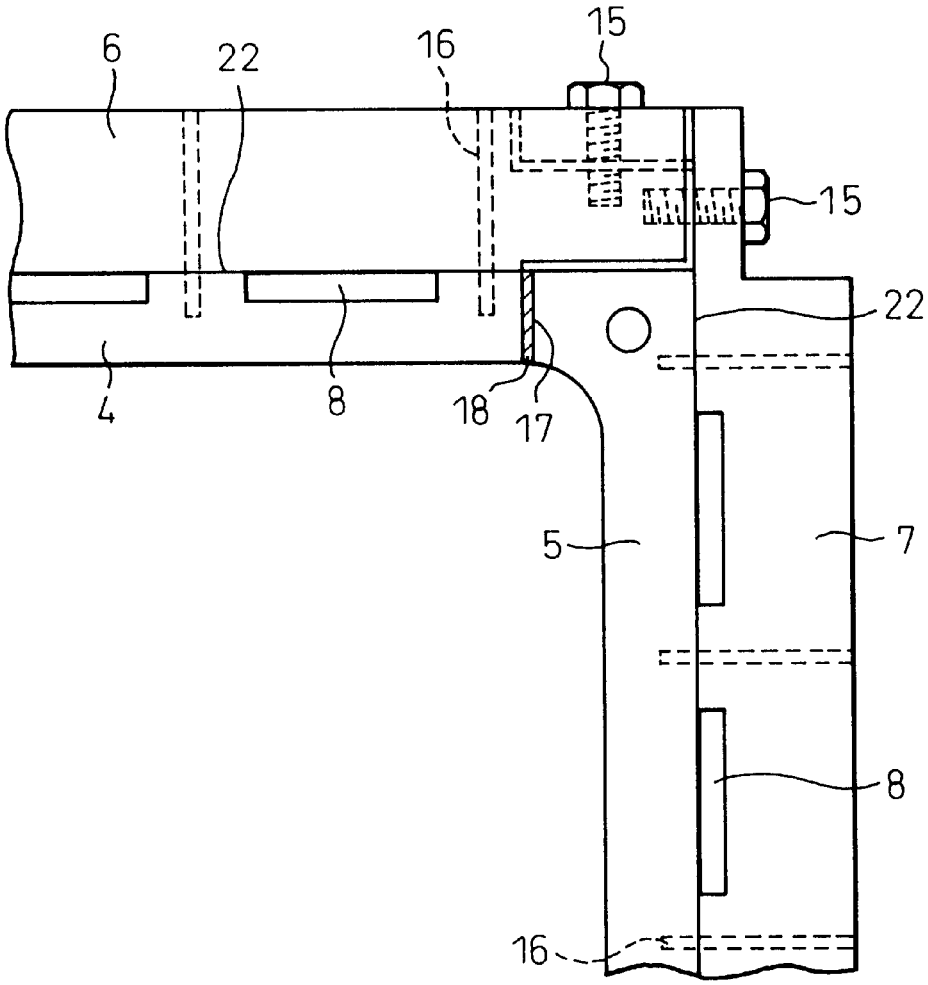
FIG. 12 shows a partial section of a mold in which the joint faces of each of the cooling copper plates and the corresponding nonmagnetic stainless steel back plate are diffusion bonded by HIP (hot isostatic pressing process; 1,500 atm.×950° C.×2 hours).

In the present invention explained above, the cooling copper plates 4, 5 are made to face the nonmagnetic stainless steel back plates 6, 7, respectively, and closed and fixed with the jointing bolts 14 to form the divided cooling portions 3 of the mold 2. However, the opposite faces between each of the cooling copper plates 4, 5 and the corresponding nonmagnetic stainless steel back plate 6 or 7 can be diffusion bonded in place of closing and fixing them with the jointing bolts 14. FIG. 12 shows a partial sectional view of a mold prepared by bonding the mutually opposite joint faces between each of the cooling copper plates 4, 5 and the corresponding nonmagnetic stainless steel back plate 6 or 7 by HIP (1,500 atm.×950° C.×2 hours). In order to prevent the warpage of the diffusion bonded faces 22 between each of the cooling copper plates 4, 5 and the corresponding back plate 6 or 7 during HIP, it is preferred to fix in advance each of the cooling copper plates 4, 5 and the corresponding back plate 6 or 7 with a pin (not illustrated) instead of bolt 14. Formation of grooves for inserting seal parts 16 provided to the peripheries of the cooling paths 8 can be omitted when the diffusion bonding is employed. As a result, there is no restriction imposed by the heat-resistant temperatures of the seal parts 16.

EXAMPLES

Examples 1 to 3

Using a continuous casting apparatus of the present invention, a steel was continuous cast under the conditions listed in Table 1.

TABLE 1

| | |
|---|---|
| Type of steel | S 45C |
| Slab size | 100 mm (thickness) × 400 mm (width) |
| Casting speed | 2.0 m/min |

Table 2 shows the thickness and material of the divided mold of the continuous casting apparatus.

TABLE 2

| | |
|---|---|
| Thickness of cooling copper plates | 20 mm |
| Material of cooling copper plates | Cr—Zr copper (conductivity of 80% I.A.C.S.) |
| Thickness of back plates | 50 mm |
| Material of back plates | SUS 304 |

The continuous casting mold of the present invention was equipped with an electromagnetic coil for exciting electromagnetic force in a direction vertical to the inner wall of the mold near the initially solidified portion of meniscus of the molten metal. Table 3 lists the conditions under which the electromagnetic coil was used.

TABLE 3

| | |
|---|---|
| Applied voltage | 2.60 MW |
| Frequency | 200 Hz |
| Time period for applying rectangular pulse | 75 msec ON |
| Time period for not applying rectangular pulse | 75 msec OFF |

The shorter side cooling portions (formed with the first cooling copper plates and the first back plates) of the mold, and the longer side cooling portions (formed with the second cooling copper plates and the second back plates) of the mold were divided in such a manner as shown in Table 4 under the conditions mentioned above.

TABLE 4

| | |
|---|---|
| Ex. 1 | Sixfold division (second cooling copper plates alone on the longer sides of the mold being divided, insulating material being present between each of the back plates and the corresponding cooling copper plate) |
| Ex. 2 | Sixfold division (both the second cooling copper plates of the longer sides of the mold and the back plates of the longer sides being divided, no insulating material being present between each of the back plates and the corresponding cooling copper plate) |
| Ex. 3 | Fourfold division (the corner portions each formed with one of the divided second cooling portions of the longer sides of the mold and the corresponding divided first cooling portion being insulation divided, and no insulation material being present between each of the back plates and the corresponding cooling copper plate) |
| Comp. Ex. 1 | Sixfold division (second cooling copper plates alone on the longer sides of the mold being divided, no insulating material being present between the back plates and the cooling copper plates) |
| Comp. Ex. 2 | Integrated type |

Using the molds in Examples 1 to 3 and Comparative Examples 1 to 2, slabs having dimensions shown in Table 1 were prepared. Table 5 shows the average surface roughness ($\mu$m) of each of the slabs.

TABLE 5

| Ex. No. | Dimensions of mold width (m) | Dimensions of mold thickness (m) | Peripheral length L (m) | Cu plate thickness $t_1$ (m) | Back plate thickness $t_2$ (m) | Number of division n (–) | Frequency f (Hz) | Applied power P (MW) | A in formula (1) | Casting results av. surface roughness ($\mu$m) |
|---|---|---|---|---|---|---|---|---|---|---|
| 1 | 0.40 | 0.10 | 1.00 | 0.020 | 0.050 | 6 | 200 | 2.60 | 1.05 | 100 |
| 2 | 0.40 | 0.10 | 1.00 | 0.020 | 0.050 | 6 | 200 | 2.60 | 1.05 | 90 |
| 3 | 0.40 | 0.10 | 1.00 | 0.020 | 0.050 | 4 | 200 | 2.60 | 0.70 | 140 |
| CE1 | 0.40 | 0.10 | 1.00 | 0.020 | 0.050 | 6 | 200 | 2.60 | 1.05 | 140 |
| CE2 | 0.40 | 0.10 | 1.00 | 0.020 | 0.050 | 1 | 200 | 2.60 | 0.18 | 570 |

Note: CE = Comparative Example

Examples 4 to 9

Using the continuous casting apparatuses of the present invention and the apparatuses of the prior art, medium carbon steels (S12C, C=0.10 to 0.12) were cast. Table 6 shows the casting conditions and the casting results. The following are clear from the casting results in Table 6. In Example 4, the resultant surface smoothness was substantially satisfactory, and the effective magnetic pressure factor A was 0.55; in Comparative Example 3, the resultant surface smoothness was not satisfactory, and the effective magnetic pressure factor A was 0.11; in Comparative Example 4, the effective magnetic pressure factor A was 1.77, and cracks were formed on the slab surface.

TABLE 6

| Ex. No. | Dimensions of mold width (m) | Dimensions of mold thickness (m) | Peripheral length L (m) | Cu plate thickness $t_1$ (m) | Back plate thickness $t_2$ (m) | Number of division n (–) | Frequency f (Hz) | Applied power P (MW) | A in formula (1) | Casting results av. surface roughness (μm) |
|---|---|---|---|---|---|---|---|---|---|---|
| 4 | 0.16 | 0.16 | 0.64 | 0.014 | 0.025 | 4 | 200 | 0.50 | 0.30 | 300 |
| 5 | 0.16 | 0.16 | 0.64 | 0.014 | 0.025 | 4 | 200 | 1.00 | 0.61 | 160 |
| 6 | 0.40 | 0.10 | 1.00 | 0.020 | 0.050 | 4 | 200 | 3.00 | 0.81 | 120 |
| 7 | 0.40 | 0.10 | 1.00 | 0.020 | 0.050 | 6 | 200 | 3.00 | 1.21 | 80 |
| 8 | 0.80 | 0.10 | 1.80 | 0.020 | 0.050 | 4 | 200 | 3.00 | 0.45 | 200 |
| 9 | 0.80 | 0.10 | 1.80 | 0.020 | 0.050 | 8 *1 | 200 | 3.00 | 0.90 | 110 |
| 10 | 0.40 | 0.40 | 1.60 | 0.020 | 0.050 | 8 *2 | 200 | 3.00 | 1.01 | 100 |
| CE3 | 0.16 | 0.16 | 0.64 | 0.014 | 0.025 | 1 | 200 | 1.00 | 0.15 | 650 |
| CE4 | 0.16 | 0.16 | 0.64 | 0.014 | 0.025 | 4 | 200 | 3.00 | 1.83 | X *3 |

Note:
*1 Threefold division of (longer side copper plates + corresponding back plates) (no insulating material being present between back plates and corresponding cooling copper plates)
*2 Twofold division of (longer side copper plates + corresponding back plates), twofold division of (shorter side copper plates + corresponding back plates)
*3 Bleed being formed
CE = Comparative Example The other casting conditions were as follows: a casting speed of 1.2 m/min; and intermittent application of an electric current (0.075 sec ON –0.075 sec OFF).

The continuous casting apparatus for molten metal of the present invention permits decreasing the number of division of the cooling copper plates and the back plates forming the divided cooling portions of the mold because a low-frequency alternating current is applied, reinforcing the rigidity of the mold by supporting and fixing each of the cooling copper plates of the mold with the corresponding respective nonmagnetic back plates, increasing the cooling area, and cutting the production cost. Consequently, it becomes possible to stabilize the level of the molten metal, smooth the slab surface properties, and make the casting speed high.

In the present invention, a mold is divided in the casting direction over the entire length, and as a result the joint faces of each of the cooling copper plates and its adjacent cooling copper plate can be worked with high precision. Consequently, electrically insulating ceramic plates can be bonded to the joint faces, and the joint faces can be flame sprayed with electrically insulating ceramics; adhesion of the joint faces between each of the cooling copper plates of the mold and its adjacent cooling copper plate is improved; the heat resistance of the mold is improved, which permits long term use of the mold.

In the present invention, the fixing face of a cooling copper plate and that of a corresponding back plate in the divided cooling portions of the mold can be closed and fixed with bolts. Furthermore, the cooling copper plate and the back plate can also be jointed and fixed by diffusion bonding the fixed faces. The procedure has the following advantages: use of an O-ring becomes unnecessary; the cooling area is enlarged; the heat resistance is improved; and machining the mold can be simplified.

What is claimed is:

1. A continuous casting apparatus for molten metal wherein electromagnetic force is applied in a direction vertical to the inner wall of a continuous casting mold (2) near or initially solidified portion (21) of a meniscus of molten metal (12) within the mold, the continuous casting apparatus (1) comprising, around the periphery of the mold, an electromagnetic coil (10) to which low-frequency alternating current at a frequency of several tens to several hundreds of Hertz is continuously or intermittently applied, the mold comprising first cooling copper plates (4) and second cooling copper plates (5) forming inner portions of the mold, and first nonmagnetic stainless steel back plates (6) and second nonmagnetic stainless steel back plates (7) forming outer portions of the mold, the mold comprising a pair of the first cooling copper plates (4) and the first nonmagnetic stainless steel back plates (6) used in combination with the first cooling copper plates, a pair of the second cooling copper plates (5) and the second nonmagnetic stainless steel back plates (7) used in combination with the second cooling copper plates, and a plurality of divided cooling portions (3) containing insulating material (18), the first cooling copper plates and the second cooling copper plates each having at least one groove (8) on the side opposite to a casting face (23), each of the first and second back plates closing and fixing a face side having the at least one groove of the corresponding first or second cooling copper plate, whereby the grooves form cooling paths (8), the first cooling copper plates and the second cooling copper plates being electrically insulated from each other through insulating material (18), and the first back plates and the second back plates being insulated from each other and fastened together while they are mutually in an electrically insulated state.

2. A continuous casting apparatus for molten metal wherein electromagnetic force is applied in a direction vertical to the inner wall of a continuous casting mold (2) near an initially solidified portion (21) of a meniscus of molten metal (12) within the mold, the continuous casting apparatus (1) comprising around the periphery of the mold an electromagnetic coil (10) to which a low-frequency alternating current at a frequency of several tens to several hundreds of Hertz is continuously or intermittently applied, the mold comprising first cooling copper plates (4) and second cooling copper plates (5) forming inner portions of the mold, and first nonmagnetic stainless steel back plates (6) and second nonmagnetic stainless steel back plates (7) forming outer portions of the mold, the mold comprising a pair of the first cooling copper plates (4) and the first nonmagnetic stainless steel back plates (6) used in combination with the first cooling copper plates, a pair of the second cooling copper plates (5) and the second nonmagnetic stainless steel back plates (7) used in combination with the second cooling copper plates, and a plurality of divided cooling portions (3) containing insulating material (18), the first cooling copper plates and the second cooling copper plates each having at least one groove (8) on the side opposite to a casting face (23), the second cooling copper plates being each divided into at least two through the entire length in the casting direction (X), and each of the first cooling copper plates being insulated from adjacent divided second cooling copper plates through insulating material (18), each of the first back plates closing and fixing a face side having the at least one groove of the corresponding first cooling copper plate, whereby the grooves form cooling paths (8), insulating material (18) being inserted between each of the second back plates and the corresponding divided second cooling copper plates, and each of the second back plates insulating, closing and fixing the face side having grooves of the corresponding second cooling copper plates, whereby the second cooling copper plates are insulated from each other through the insulating material and the grooves of the second cooling copper plates form cooling paths (8), and the first back plates and the second back plates being insulated and fastened together while they are mutually in an electrically insulated state.

3. The continuous casting apparatus according to claim 2, wherein each of the second back plates is divided into at least two through the entire length in the casting direction, the second back plates and the corresponding respective second cooling copper plates are electrically contacted with or insulated from each other, each of the second back plates which are in a state of being divided into at least two are insulated and fastened together while they are mutually in an electrically insulated state, and the periphery of the first and second back plates of the mold is fastened with a back frame (24) fixed to an outer frame (25).

4. A continuous casting apparatus for molten metal wherein electromagnetic force is applied in a right angled direction to the inner wall of a continuous casting mold (2) near an initially solidified portion (21) of a meniscus of molten metal (12) within the mold, the continuous casting apparatus (1) comprising, around the periphery of the mold, an electromagnetic coil (10) to which a low-frequency alternating current at a frequency of several tens to several hundreds of Hertz is continuously or intermittently applied, the mold comprising first cooling copper plates (4) and second cooling copper plates (5) forming inner portions of the mold and first nonmagnetic stainless steel back plates (6) and second nonmagnetic stainless steel back plates (7) forming outer portions of the mold and insulating material (18) provided in at least one portion between the first and second copper cooling plates and the first and second nonmagnetic stainless steel back plates, the mold comprising a pair of the first cooling copper plates (4) and the first nonmagnetic stainless steel back plates (6) used in combination with the first cooling copper plates, a pair of the second cooling copper plates (5) and the second nonmagnetic stainless steel back plates (7) used in combination with the second cooling copper plates, and a plurality of divided cooling portions (3) containing the insulating material (18), the first cooling copper plates and the second cooling copper plates each having at least one groove (8) on the side opposite to a casting face (23), the first and second cooling copper plates being each divided into at least two through the entire length in the casting direction (X), and the divided first cooling copper plates and the divided second cooling copper plates being insulated from each other through insulating material (18), insulating material (18) being inserted between each of the first back plates and the corresponding divided first cooling copper plates and between each of the second back plates and the corresponding divided second cooling copper plates, and each of the first back plates insulating, closing and fixing a face side having grooves of the corresponding first cooling copper plates and each of the second back plates insulating, closing and fixing the face side having grooves of the corresponding second cooling copper plates, whereby the first and second cooling copper plates are insulated from each other through the insulating material and the grooves of the first and second cooling copper plates form cooling paths (8), and the first back plates and the second back plates being insulated and fastened together while they are mutually in an electrically insulated state.

5. The continuous casting apparatus according to claim 4, wherein each of the first back plates and/or each of the second back plates is divided into at least two through the entire length in the casting direction, the divided first back plates and the corresponding respective first cooling copper plates are electrically contacted with or insulated from each other and/or the divided second back plates and the corresponding respective second back plates are electrically contacted with or insulated from each other, the back plates in a state of being divided into at least two are insulated from each other and fastened together while they are mutually in an electrically insulated state, and the periphery of the first back plates and the second back plates of the mold is fastened with a back frame (24) fixed to an outer frame (25).

6. The continuous casting apparatus according to claim 1, wherein the first back plates and the second back plates each comprise cooling holes (9) which are partially or entirely extended in each of the back plates.

7. The continuous casting apparatus according to claim 1, wherein the conditions of the mold are determined in order to allow an effective magnetic pressure factor A which is for exciting an electromagnetic force in a direction vertical to the inner wall of the mold near the initially solidified portion of the meniscus of the molten metal and which is defined by the following formula to fall into a specific range:

$$A=P\times n/\{L\times(50t_1+t_2)\times\sqrt{f}\}$$

wherein P is an applied power of a power source for exciting electromagnetic force, n is a number of divisions of the mold, L is an inner peripheral length of the mold, f is a frequency of the power source for exciting electromagnetic force, $t_1$ is a thickness of a copper plate and $t_2$ is a thickness of a back plate.

8. The continuous casting apparatus according to claim 1, wherein the pitch of division of the divided second cooling copper plates, or the divided first and second cooling copper plates, or the divided cooling copper plates and the divided back plates is at least 100 mm.

9. The continuous casting apparatus according to claim 1, wherein the insulating material is an electrically insulating ceramic plate.

10. The continuous casting apparatus according to claim 1, wherein copper plate—copper plate joint faces of any of the cooling copper plates and its adjacent cooling copper plate, copper plate—back plate joint faces of any of the cooling copper plates and its corresponding back plate, or back plate—back plate joint faces of any of the back plates and its adjacent back plate are flame sprayed with electrically insulating ceramics in place of the insulating material.

11. The continuous casting apparatus according to claim 1, wherein the closing and fixing of the cooling path side of each of the cooling copper plates and the cooling path side of the corresponding nonmagnetic stainless steel back plate is conducted by diffusion bonding.

* * * * *